US006619644B1

(12) United States Patent
Liou

(10) Patent No.: US 6,619,644 B1
(45) Date of Patent: Sep. 16, 2003

(54) VISE

(76) Inventor: Ferng-Jong Liou, No. 101, Jong Shing Rd., Sec. 2, Dah-Lii City, Taichung Hsien (TW)

( * ) Notice: Subject to any disclaimer, the term of this patent is extended or adjusted under 35 U.S.C. 154(b) by 0 days.

(21) Appl. No.: 10/234,123

(22) Filed: Sep. 5, 2002

(51) Int. Cl.[7] ..... B25B 1/02
(52) U.S. Cl. ..... 269/185; 269/244; 269/253
(58) Field of Search ..... 269/184, 185, 269/187, 253, 244

(56) References Cited

U.S. PATENT DOCUMENTS 226,841 A * 4/1880 Fisher ..... 269/185
978,900 A * 12/1910 Kirkpatrick ..... 269/184
2,138,245 A * 11/1938 Smith ..... 269/185
6,135,435 A * 10/2000 Schmitz ..... 269/185

* cited by examiner

*Primary Examiner*—Robert C. Watson
(74) *Attorney, Agent, or Firm*—Troxell Law Office PLLC

(57) ABSTRACT

A vise includes a screw rod extended through an adjustable and a fixed jaw. The adjustable jaw is internally provided with a cam sleeve having a centered cam-shaped bore and two opposite arms outward projected therefrom. The cam-shaped bore is slightly larger than an outer diameter of the screw rod, and provided at one lateral surface with a small length of screw threads. When the screw rod is turned clockwise, it brings the cam sleeve to rotate at the same time while moves in the cam-shaped bore to mesh with the screw threads in the bore, causing the cam sleeve to axially move along the screw rod and finely shifts the adjustable jaw relative to the fixed jaw. And, when the screw rod is turned counterclockwise, it disengages from the screw threads in the cam-shaped bore, allowing the cam sleeve to freely and quickly move along the screw rod.

5 Claims, 3 Drawing Sheets

VISE

BACKGROUND OF THE INVENTION

The present invention relates to a vise, and more particularly to a vise that can be easily operated to enable both fine adjustment and quick movement of an adjustable jaw related to a fixed jaw.

There are various kinds of vises available in the markets. However, most of these currently available vises have an adjustable jaw that could only be finely adjusted in position related to a fixed jaw in a very slow manner. Only a very small part of the conventional vises are designed to have an adjustable jaw that can be finely adjusted and quickly moved relative to the fixed jaw, but they all have very complicate structure to be manufactured at high cost, and are not convenient for use.

SUMMARY OF THE INVENTION

A primary object of the present invention is to provide a vise that can be easily operated to achieve both quick movement and fine adjustment of the adjustable jaw relative the fixed jaw.

Another object of the present invention is to provide a vise that has simple structure to enable manufacture thereof at reduced cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
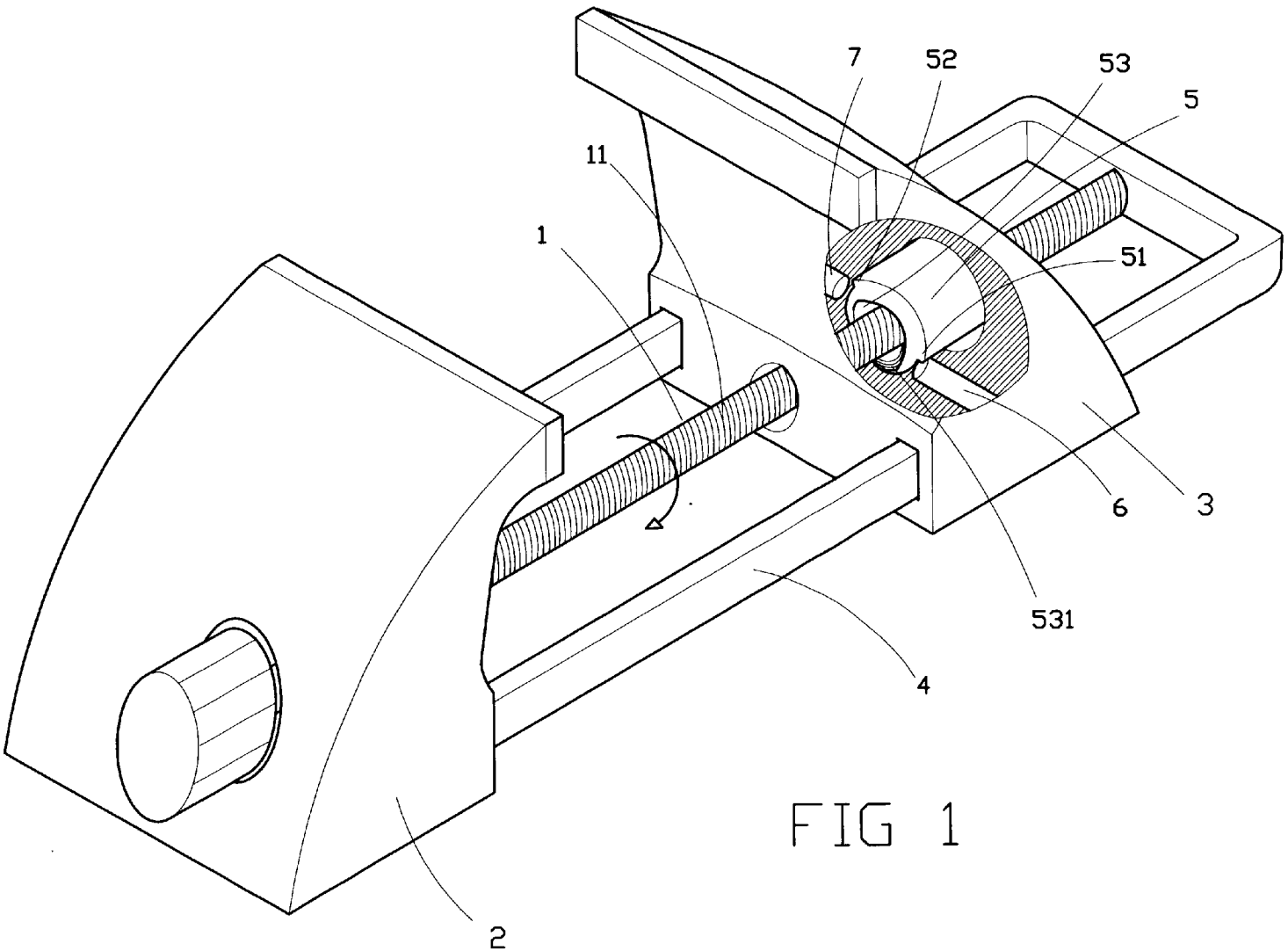
FIG. 1 is an assembled and partially cutaway perspective view of a vise according to the present invention.

Please refer to FIG. 1 that is an assembled and partially cutaway perspective view of a vise according to the present invention. As shown, the vise mainly includes a screw rod 1 provided with external threads 11, an adjustable jaw 2, a fixed jaw 3, a pair of guide rails 4 extended through the two jaws 2, 3 to parallelly locate at two sides of the screw rod 1, and a cam sleeve 5 movably mounted in the adjustable jaw 2 around the screw rod 1. The adjustable jaw 2 is internally provided at predetermined positions with two substantially opposite shafts 6, 7 that inward extend from two sides of the jaw 2 toward the cam sleeve 5.

Figure 2:
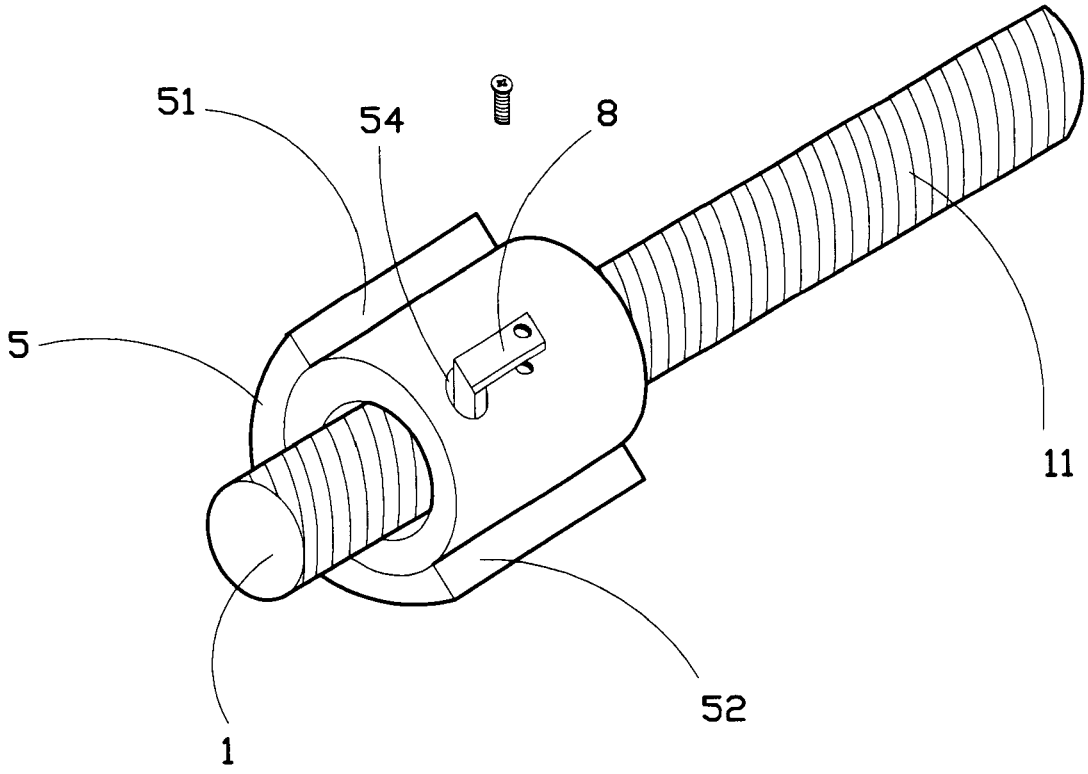
FIG. 2 is a fragmentary perspective view showing the structural relation among a screw rod, a cam sleeve, and an elastic member of the present invention.

Please refer to FIGS. 1 and 2 at the same time. The cam sleeve 5 is provided on an outer peripheral surface at two opposite positions with two outward projected arms 51, 52. A central portion of the cam sleeve 5 is formed of a cam-shaped bore 53. The bore 53 is sized to be slightly larger than an outer diameter of the screw rod 1, so that the screw rod 1 is extended through the cam sleeve 5 to be movable in the cam-shaped bore 53. As can be seen from FIG. 2, the cam sleeve 5 is provided on the outer peripheral surface at a predetermined position with a through hole 54 to communicate with the bore 53. An elastic member 8 is screwed to the outer peripheral surface of the cam sleeve 5 with an end of the elastic member 8 extended into the through hole 54 to contact with an outer circumferential surface of the screw rod 1 (see FIGS. 3 to 5). The bore 53 is provided along a small length of one lateral surface with limited number of screw threads 531, with which the external threads 11 of the screw rod 1 are detachably meshed.

Figure 3:
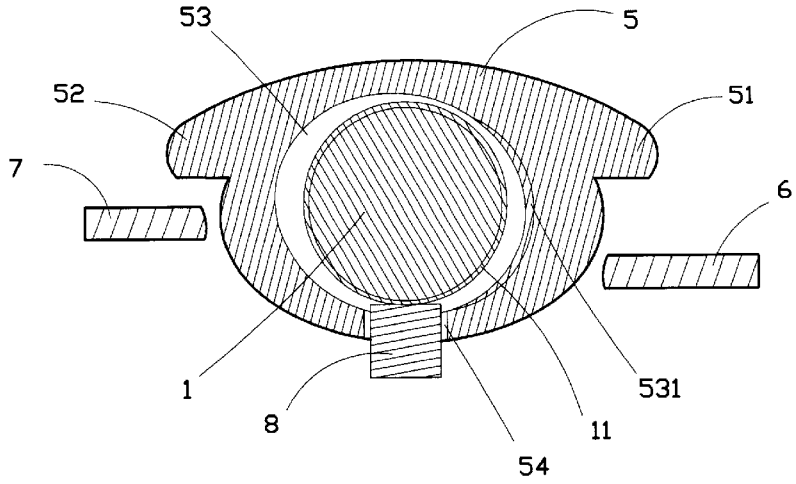
FIG. 3 is a first cross-sectional view showing the operation of the present invention.
Figure 4:
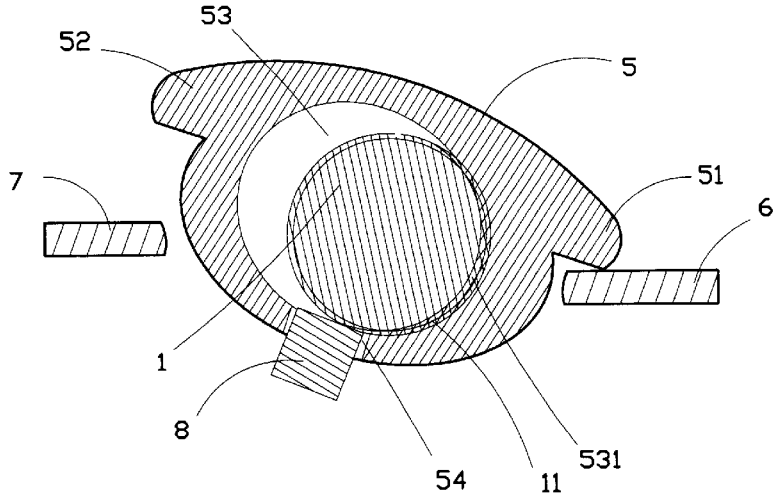
FIG. 4 is a second cross-sectional view showing the operation of the present invention.
Figure 5:
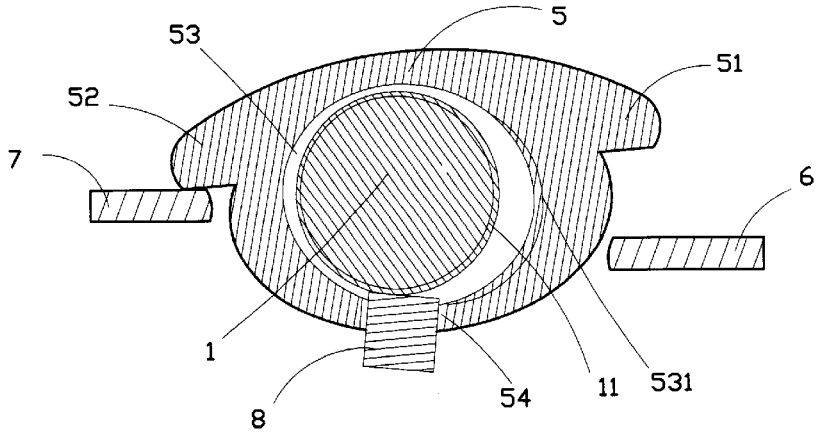
FIG. 5 is a third cross-sectional view showing the operation of the present invention.

Please refer to FIGS. 3 to 5 that together shows the manner of operating the vise of the present invention.

When an operator turn the screw rod 1 clockwise, the cam sleeve 5 is brought to move along with the screw rod 1. At this point, the screw rod 1 initially located at a middle position in the bore 53, as shown in FIG. 3, is moved to one lateral side (that is, the right side) of the bore 53, as shown in FIG. 4, and the cam sleeve 5 is moved from a first position shown in FIG. 3 to a second position shown in FIG. 4. When the cam sleeve 5 is in the second position of FIG. 4, the outward projected arm 51 of the cam sleeve 5 is in contact with the inward extended shaft 6 in the adjustable jaw 2. The shaft 6 pushes the arm 51 upward to cause the external threads 11 of the screw rod 1 to mesh with the screw threads 531 provided in the bore 53 of the cam sleeve 5. When the operator keeps turning the screw rod 1, the cam sleeve 5, which is now meshing with the screw rod 1, is brought by the screw rod 1 to rotate while moves along the screw rod 1, and thereby brings the adjustable jaw 2, in which the cam sleeve 5 is mounted, to axially move along the guide rails 4 and be finely adjusted in its position relative to the fixed jaw 3.

And, when the operator turns the screw rod 1 counterclockwise, the cam sleeve 5 is brought to move along with the screw rod 1 again from the second position shown in FIG. 4 to a third position shown in FIG. 5. When the cam sleeve 5 is in the third position shown in FIG. 5, the outward projected arm 52 opposite to the arm 51 is in contact with the other inward extended shaft 7 in the adjustable jaw 2. The shaft 7 pushes the arm 52 of the cam sleeve 5 upward that causes the external threads 11 of the screw rod 1 to disengage from the screw threads 531 of the bore 53 of the cam sleeve 5, and the screw rod 1 is now freely located in the bore 53. At this point, the operator may manually pull or push the adjustable jaw 2 along the guide rails 4 and the screw rod 1 to quickly adjust the adjustable jaw 2 relative to the fixed jaw 3.

What is claimed is:

1. A vise, comprising:

a screw rod provided with external threads;

an adjustable jaw and a fixed jaw;

a pair of guide rails extended through said adjustable and said fixed jaw to parallelly locate at two sides of said screw rod; and a cam sleeve movably mounted in said adjustable jaw around said screw rod;

said adjustable jaw being internally provided at predetermined positions with two substantially opposite shafts that inward extend from two sides of said adjustable jaw toward said cam sleeve; and said cam sleeve being provided on an outer peripheral surface at two opposite positions with two outward projected arms, and at a central portion with a cam-shaped bore; said bore being sized to be slightly larger than an outer diameter of said screw rod to allow said screw rod to extend through said cam sleeve to move in said cam-shaped bore.

2. The vise as claimed in claim 1, wherein said cam sleeve is provided on said outer peripheral surface at a predetermined position with a through hole to communicate with said cam-shaped bore.

3. The vise as claimed in claim 2, wherein said through hole on said cam sleeve has an elastic member screwed thereto.

4. The vise as claimed in claim 3, wherein said elastic member screwed to said through hole on said cam sleeve has an end extended into said cam-shaped bore via said through hole to contact with said outer peripheral surface of said screw rod.

5. The vise as claimed in claim 1, wherein said cam-shaped bore of said cam sleeve is provided along a small length of one lateral surface with limited number of screw threads.

* * * * *